US008923538B2

(12) United States Patent
Kornagel

(10) Patent No.: US 8,923,538 B2
(45) Date of Patent: Dec. 30, 2014

(54) METHOD AND DEVICE FOR FREQUENCY COMPRESSION

(75) Inventor: Ulrich Kornagel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/876,899

(22) PCT Filed: Sep. 29, 2010

(86) PCT No.: PCT/EP2010/064480

§ 371 (c)(1), (2), (4) Date: Mar. 29, 2013

(87) PCT Pub. No.: WO2012/041373

PCT Pub. Date: Apr. 5, 2012

(65) Prior Publication Data

US 2013/0188815 A1 Jul. 25, 2013

(51) Int. Cl.
*H04R 25/00* (2006.01)
*H04R 15/00* (2006.01)

(52) U.S. Cl.
CPC ..... *H04R 25/00* (2013.01); *H04R 2225/43* (2013.01); *H04R 25/353* (2013.01)
USPC ..... 381/316; 381/94.7

(58) Field of Classification Search
CPC ..... H04R 25/353
USPC ..... 381/316, 94.7; 700/94
See application file for complete search history.

(56) References Cited

U.S. PATENT DOCUMENTS

| | | | | |
|---|---|---|---|---|
| 4,051,331 | A | 9/1977 | Strong et al. | |
| 6,577,739 | B1 | 6/2003 | Hurtig et al. | |
| 8,000,487 | B2 * | 8/2011 | Fitz et al. | 381/316 |
| 8,098,859 | B2 | 1/2012 | Zeng et al. | |
| 2005/0141737 | A1 * | 6/2005 | Hansen | 381/316 |
| 2008/0310659 | A1 * | 12/2008 | Kim et al. | 381/316 |
| 2010/0278356 | A1 * | 11/2010 | Hersbach et al. | 381/98 |

FOREIGN PATENT DOCUMENTS

| | | | |
|---|---|---|---|
| EP | 2 099 235 | A2 | 9/2009 |
| WO | 2006/133431 | A2 | 12/2006 |

* cited by examiner

*Primary Examiner* — Brian Ensey
*Assistant Examiner* — Norman Yu
(74) *Attorney, Agent, or Firm* — Laurence A. Greenberg; Werner H. Stemer; Ralph E. Locher

(57) ABSTRACT

Artifacts are reduced during a frequency compression of an audio signal in a hearing device, in particular in a hearing aid. An amplitude information of a source channel is obtained, for example a spectral envelope, from several frequency channels of the audio signal. An amplitude corresponding to the amplitude information is then applied on a signal in a target channel of the several frequency channels, on which the source channel is represented during frequency compression.

13 Claims, 3 Drawing Sheets

METHOD AND DEVICE FOR FREQUENCY COMPRESSION

BACKGROUND OF THE INVENTION

Field of the Invention

The present invention relates to a method for frequency compression of an audio signal in a hearing apparatus. Moreover, the present invention relates to a corresponding device for frequency compression. Here, a hearing apparatus is understood to be any sound-emitting instrument that can be worn in or on the ear, more particularly a hearing aid, a headset, headphones and the like.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, however, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electromechanical transducer, e.g. a bone conduction receiver. The amplifier is usually integrated into a signal-processing unit. This basic design is illustrated in FIG. 1 using the example of a behind-the-ear hearing aid. One or more microphones 2 for recording the sound from the surroundings are installed in a hearing-aid housing 1 to be worn behind the ear. A signal-processing unit 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer using a sound tube, which is fixed in the auditory canal with an ear mold. A battery 5, likewise integrated into the hearing-aid housing 1, supplies the hearing aid and, in particular, the signal-processing unit 3 with energy.

Many types of loss of hearing can be compensated for with the aid of a frequency-dependent amplification in combination with dynamic compression. However, there are also types of loss of hearing in which amplification has no effect or is disadvantageous. Examples of this are types of loss of hearing with so-called "dead regions". "Dead regions" are frequency regions in which spectral components can no longer be made audible by amplification.

A possible technique for handling the aforementioned problem lies in frequency compression. Here, spectral components from a source frequency range, which typically lies at higher frequencies and in which no amplification should be applied (e.g. "dead region"), are pushed into a lower target frequency range. Audibility is, in principle, generally ensured in this target frequency range, which is why amplification can be applied in a beneficial fashion.

By way of example, known frequency compressions operate in the following manner: a compression prescription is tailored to an individual type of loss of hearing, wherein the compression prescription defines which source frequency should be compressed or mapped onto which target frequency. The practical realization of this compression prescription is brought about by a filter bank. That is to say, the compression prescription defines which source channel in the filter bank is mapped or compressed onto which target channel. The smallest element of this method is therefore a channel. This means that the spectral components within one channel are not compressed. Moreover, the possible positions of the channels are defined and hence fixedly prescribed by the structure of the filter bank (fixed filter bank raster).

However, the aforementioned method for frequency compression is unsuitable for sound of speech in particular. In sound of speech, there is a fundamental frequency and a plurality of harmonics, which are found at integer multiples of the fundamental frequency, in the case of voiced sounds. This is referred to as fine structure of the signal. The fine structure is responsible for the perception of the pitch of the sound of speech. The amplitudes of the fundamental frequency and the harmonics define the color of the sound and form the so-called spectral envelope. By way of example, the spectral envelope of vowels respectively shows a typical formant structure. The spectral envelope carries the essential information which makes it possible to distinguish the different sounds (e.g. distinguish the vowels).

As described above, the frequency compression according to the prior art is achieved by shifting source channels on a fixed filter bank raster. The fixed filter bank raster is defined by the filter bank structure and not by the harmonic structure of the signal. Therefore a movement of source channels on the fixed filter bank raster to the target channels thereof in accordance with the compression prescription destroys the harmonic structure. The reason for this lies in the fact that the harmonic structure is simply not taken into account during the shift. That is to say, the harmonics no longer necessarily occur at integer multiples of the fundamental frequency after the compression. The destruction of the harmonic structure however leads to audible artifacts.

BRIEF SUMMARY OF THE INVENTION

Therefore, the object of the present invention consists of being able to avoid artifacts during the frequency compression in an improved fashion.

According to the invention, this object is achieved by a method for frequency compression of an audio signal in a hearing apparatus, by obtaining amplitude information of a source channel from a plurality of frequency channels of the audio signal and applying an amplitude corresponding to the amplitude information to a signal in a target channel of the plurality of frequency channels, on which the source channel is mapped during the frequency compression.

Moreover, according to the invention, provision is made for a device for frequency compression of an audio signal for a hearing apparatus, comprising an estimation apparatus for obtaining amplitude information of a source channel of a plurality of frequency channels of the audio signal and a processing apparatus for applying an amplitude corresponding to the amplitude information to a signal in a target channel of the plurality of frequency channels, on which the source channel is to be mapped for the frequency compression.

Advantageously, the amplitude information in a source channel of an audio signal is separated from the actual signal and used to apply a corresponding amplitude to a signal in a target channel. Frequencies in the target channel are not influenced thereby, as a result of which the harmonic structure of the audio signal can be maintained.

The amplitude information can be a mean channel amplitude. This can easily be obtained for a channel and can likewise be transmitted to a target channel with little complexity.

The amplitude information is preferably a spectral model of the audio signal, the spectral model is subjected to the frequency compression and the amplitude to be applied to the signal of the target channel is established from the compressed spectral model. By way of example, the spectral model is the spectral envelope, which emerges from the amplitudes of the fundamental frequency and the harmonics of a harmonic signal. The spectral model therefore represents a function which, in an exemplary fashion, reproduces the amplitude values over the frequency.

The amplitude to be applied for the target channel can be obtained by scanning the compressed spectral model. Thus, the amplitude for a specific frequency is obtained from the compressed spectral model or from the compressed spectral envelope.

Alternatively, the amplitude to be applied can be obtained by forming an integral or a sum of values of the compressed spectral model in the region of the target channel. As a result, a mean amplitude value for the target channel is established from the spectral model.

In one exemplary embodiment, at least one channel amplitude is obtained for each of the frequency channels and the spectral model of the audio signal is obtained from the channel amplitudes. Hence, at least one value per frequency channel is provided for the spectral model.

The spectral model can be obtained by interpolation (spline). Here, the individual points are interconnected by linear functions, quadratic functions, cubic functions and the like. However, the spectral model can also be a polynomial function. Here, the spectral model or the spectral envelope is reproduced by an analytic function. Amplitude values can in turn be obtained therefrom without much computational complexity.

However, the spectral model can also be obtained by an LPC-analysis (linear predictive coefficient) in the time domain. As a result, it is possible to dispense with a filter bank.

However, if the spectral model is obtained by e.g. interpolation, it is expedient if the device for the frequency compression has a polyphase filter bank in order to provide the audio signal in a plurality of frequency channels. As a result, it is possible only to generate positive frequency components in the channels.

The device according to the invention is used particularly advantageously in a hearing apparatus and, in particular, in a hearing aid. As a result, it is possible to realize a frequency compression with fewer artifacts for hearing-aid wearers.

The present invention will now be explained in more detail on the basis of the attached drawings, in which:

DESCRIPTION OF THE INVENTION

Figure 1:
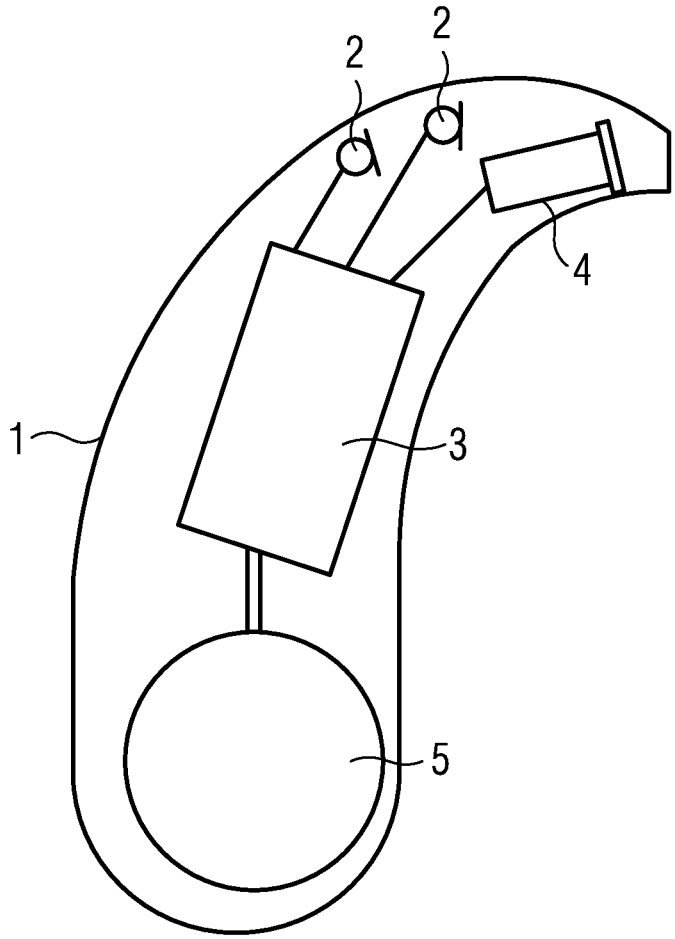
FIG 1 PRIOR ART
FIG. 1 shows the basic design of a hearing aid in accordance with the prior art.

The exemplary embodiments explained in more detail below represent preferred embodiments of the present invention.

The main goal of the present invention consists of leaving the spectral fine structure, in particular of a harmonic signal, untouched by virtue of only subjecting the amplitude information of a spectrum to a compression. In particular, it is only, for example, the spectral envelope which is compressed, which spectral envelope represents a measure for the magnitude of the amplitude in the spectrum.

In a first variant for realization, the input signal is spectrally decomposed by a filter bank. A corresponding channel intensity is calculated for each channel which takes part in the compression process. Examples for channel intensities are the amplitude, the amplitude squared or any other measure for the power or intensity of the signal in the corresponding channel. The channel intensities can be interpreted as scanned values of the spectral envelope, which values should be compressed. Here, the channel intensity constitutes amplitude information within the meaning of the present application.

The compression is achieved by shifting the channel intensities from the source channels to the target channels in accordance with a prescribed compression prescription. The original channel intensities of the target channel (prior to the compression) are overwritten. This means that, in accordance with the present invention, the phase of an original signal (prior to the compression) is maintained in the target channel. Only the channel intensities are modified. Thus, for example, the envelope is then applied to the respective signals after the filter bank, and the phases are maintained.

In principle, the compression prescription as per the present invention is similar to the compression prescription of a compression system as per the prior art. The difference between the approach according to the prior art and the approach according to the invention consists of the fact that, in accordance with the approach according to the invention, only the channel intensities are shifted, whereas in the approach according to the prior art the complete channel signals are shifted. Thus, in the approach according to the invention, the spectral fine structure is maintained. A harmonic remains a harmonic. If need be, it is only the amplitude thereof which is varied.

In a second variant for realization, the input signal is spectrally decomposed with the aid of a filter bank. The channel intensities of all channels which should be compressed are used to obtain a spectral model (e.g. an envelope curve or envelope). By way of example, this spectral model is obtained by linear interpolation, quadratic interpolation, cubic interpolation or by analytic modeling with the aid of a polynomial function. The spectral model or the envelope is compressed in accordance with the compression prescription. Finally, the compressed spectral model is used to calculate the intensities of the target channels. The phases of the target channels are not modified, as in the above-described, first variant for realization.

Specific exemplary embodiments are reproduced in detail in the following text.

Figure 2:
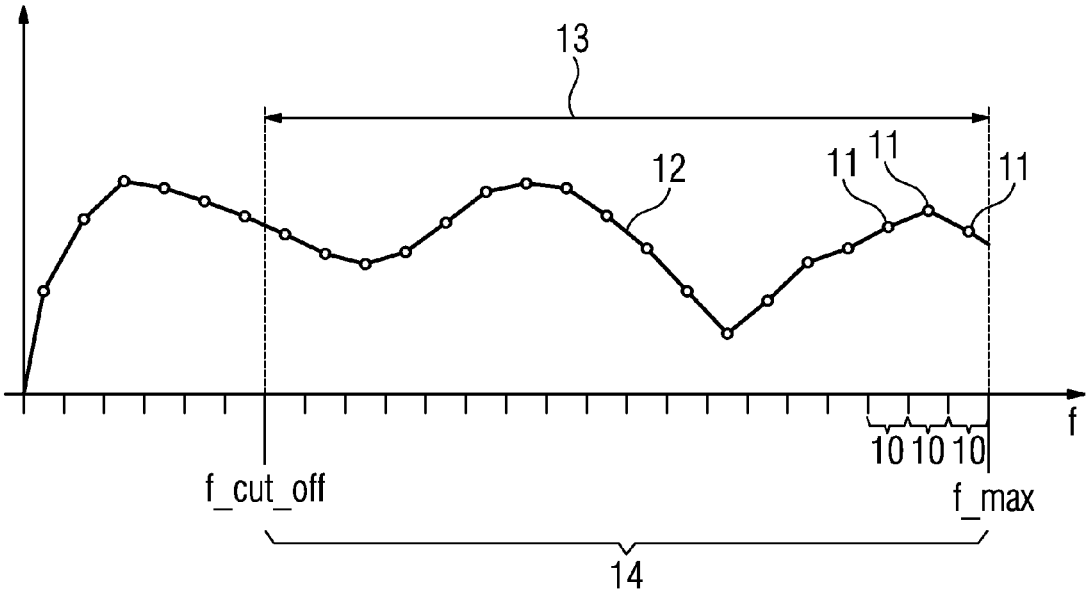
FIG. 2 shows a spectral model of an audio signal prior to compression.

FIG. 2 shows a spectral model of an input signal from a hearing aid. The channel intensity (e.g. amplitude, power etc.) is plotted over the frequency f for each of the frequency channels 10. The respective channel intensity is symbolized by a point 11. Adjacent points 11 are respectively interconnected by means of a straight line. As a result, a spectral envelope 12 is created by linear spline interpolation. The spectral envelope 12 therefore represents a spectral model of the input signal.

As a result of a hearing aid-internal compression prescription, a high-frequency component 13 of the overall spectrum is to be compressed. The compression begins at a frequency f_cut_off. The region to be compressed extends from this frequency f_cut_off to the highest processed frequency channel. The channels in the compression region 13 can be referred to as source channels 14 for the frequency compression.

Thus, all frequencies above the frequency f_cut_off are compressed in accordance with the same compression prescription, which is dependent on the type of loss of hearing. During this compression, the original envelope 12 is compressed to form the compressed envelope 12' as per FIG. 3. In a frequency region below the frequency f_cut_off, the two envelopes 12 and 12' correspond to one another. Above the frequency f_cut_off, the linearly interpolated curve from FIG. 2 is compressed onto significantly fewer frequency channels in accordance with the compression prescription. Although the structure of the envelopes is, in respect of the amplitude sequence, substantially maintained, the curve was compressed in the frequency direction. The highest frequency f_max' after the compression therefore lies below the frequency f_max in the uncompressed case as per FIG. 2. However, this also means that a multiplicity of source channels 14 are mapped to fewer target channels 15. The target channels 15 respectively have the same width as a source channel 14. That is to say, the channel structure is left untouched by the compression. Hence, it is possible to establish the channel intensity for each target channel 15 from the compressed envelope 12' (compressed spectral model), as will be shown on the basis of the examples from FIG. 4 and FIG. 5.

Figure 3:
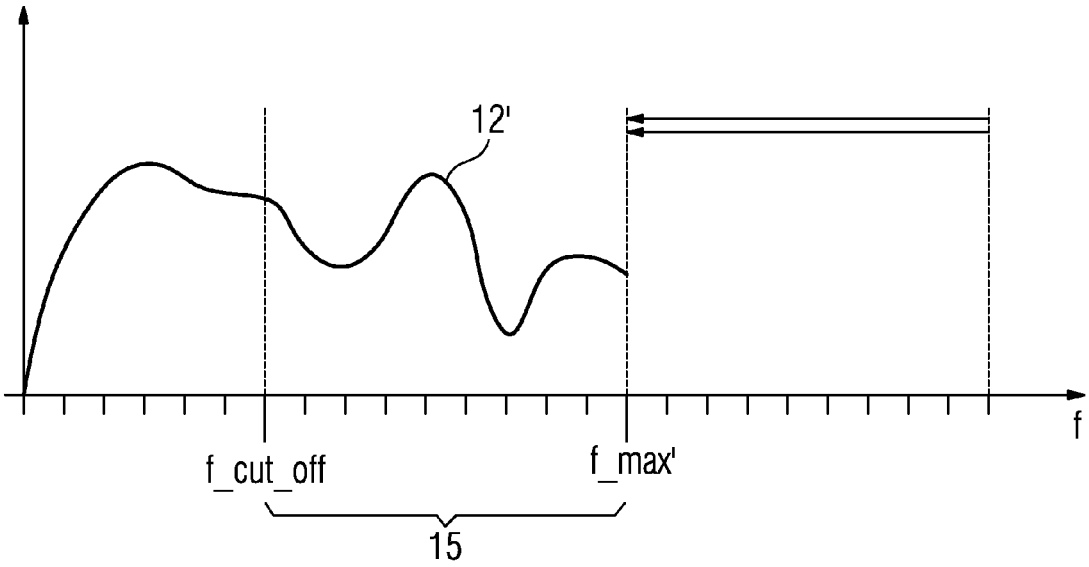
FIG. 3 shows the spectral model from FIG. 2 after the compression.
Figure 4:
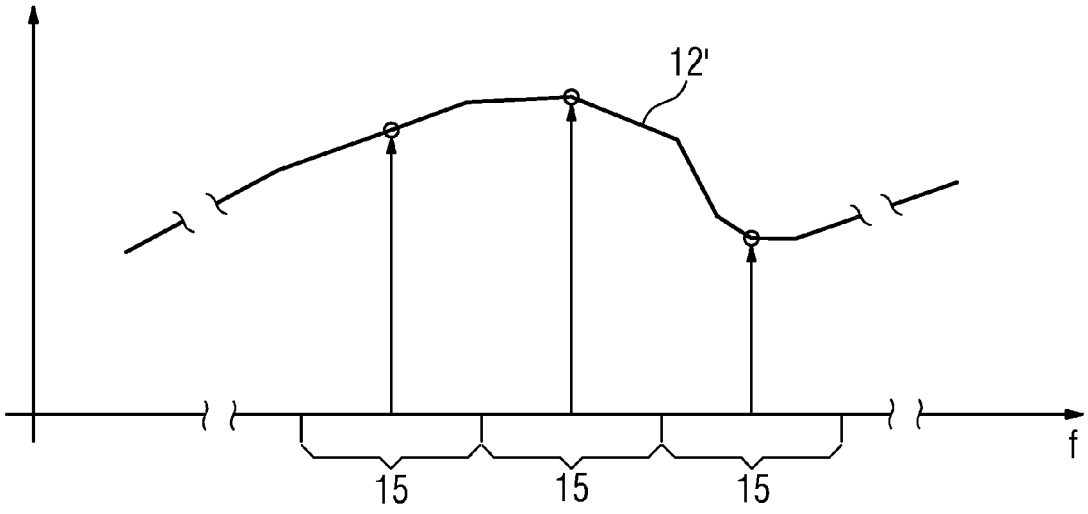
FIG. 4 shows a harmonic signal with the amplitudes of the compressed spectral model.

FIG. 4 shows a section of the target channels 15 from FIG. 3. The compressed envelope 12' is scanned in the center between the channel boundaries of each target channel 15. It is already possible to identify here that the scanned values do not necessarily lie on the inflection points of the compressed envelope 12'. Thus, the intensity of a source channel 14 is, in this case, not mapped exactly to the intensity of a target channel 15. Rather, the value for the channel intensity of the target channel is obtained directly from the scanned value, which emerges from the compressed envelope 12' at the respective channel center. In accordance with another exemplary embodiment, the scanning can however also take place at a different frequency position within each target channel 15. Thus, for example, the scanning can also take place at a channel boundary.

Figure 5:
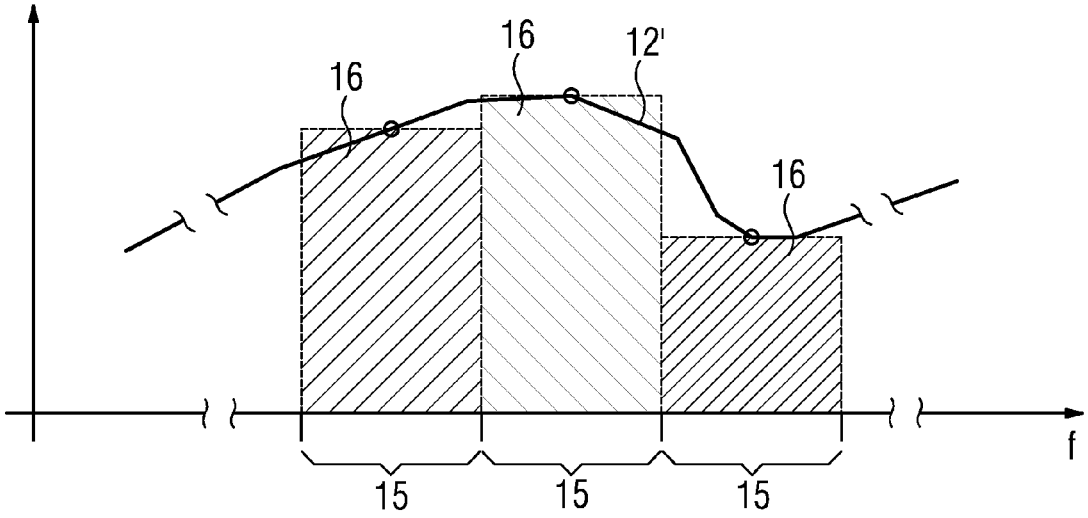
FIG. 5 shows a harmonic signal, in which the amplitudes are obtained by forming an integral.

In accordance with the example from FIG. 5, the value of a target channel 15 is established in another way. Namely, it is established by forming a mean value on the basis of an integral or a sum of all values of the compressed envelopes 12' within each channel. The respective mean value 16 then is a measure for the intensity of the target channel 15. Here too, the channel structure and, in particular, also the spacing between harmonics remain untouched by the frequency compression. All that is adapted or modified is the amplitude of the spectral components in the compressed region. In accordance with a modified embodiment, the decomposition of the input signal into the spectral fine structure and the spectral envelope can also take place with the aid of an LPC-analysis (linear predictive coefficient) and by calculating the residual signal in the time domain. As a result, no filter bank is required for obtaining the envelope, as is required for the calculation in the frequency domain.

Thus, according to the invention, there is a decomposition of the input signal into a spectral fine structure and a spectral envelope (spectral model), and the spectral envelope is compressed by a compression rule depending on the type of loss of hearing, independently of the spectral fine structure. In the process, the spectral fine structure is maintained. It follows that the harmonic structure of a tonal signal also remains untouched, and so the described artifacts do not occur or are reduced. Frequency estimation is not required for this method.

The invention claimed is:

1. A method for frequency compression of an audio signal in a hearing apparatus, the method which comprises:

providing an audio signal with a plurality of frequency channels;

acquiring amplitude information of a source channel from the plurality of frequency channels of the audio signal, applying an amplitude corresponding to the amplitude information to a signal in a target channel of the plurality of frequency channels, on which the source channel is mapped during frequency compression, and thereby overwriting an original channel intensity of the target channel and maintaining a phase of the audio signal in the target channel.

2. The method according to claim 1, wherein the amplitude information is a channel intensity that constitutes a measure for the signal power or signal intensity in the corresponding channel.

3. The method according to claim 1, wherein the amplitude information is a spectral model of the audio signal modeling amplitude values of a spectral envelope, and wherein the method comprises subjecting the spectral model to the frequency compression to form a compressed spectral model and establishing the amplitude to be applied to the signal of the target channel from the compressed spectral model.

4. The method according to claim 3, which comprises obtaining the amplitude to be applied by scanning the compressed spectral model.

5. The method according to claim 3, which comprises obtaining the amplitude to be applied by forming an integral or a sum of amplitude values of the compressed spectral model in the range of the target channel.

6. The method according to claim 3, which comprises obtaining at least one channel amplitude for each of the plurality of frequency channels and obtaining the spectral model of the audio signal from the channel amplitudes.

7. The method according to claim 6, which comprises obtaining the spectral model by interpolation.

8. The method according to claim 6, wherein the spectral model is a polynomial function.

9. The method according to claim 6, which comprises obtaining the spectral model by LPC-analysis in a time domain.

10. A device for frequency compression of an audio signal in a hearing apparatus, the device comprising:

an estimation apparatus configured for obtaining amplitude information of a source channel of a plurality of frequency channels of the audio signal; and a processing apparatus connected to said estimation apparatus and configured for applying an amplitude corresponding to the amplitude information to a signal in a target channel of the plurality of frequency channels, on which the source channel is to be mapped for the frequency compression, wherein a channel intensity of the target channel is overwritten;

said processing apparatus being configured to maintain a phase of the signal in the target channel.

11. The device according to claim 10, which comprises a polyphase filter bank configured to decompose the audio signal spectrally and to provide the audio signal in a plurality of frequency channels.

12. A hearing apparatus, comprising a device for frequency compression according to claim 10.

13. A method for frequency compression of an audio signal in a hearing apparatus, the method which comprises:

providing an audio signal with a plurality of frequency channels;

acquiring amplitude information of a source channel from the plurality of frequency channels of the audio signal;

obtaining an amplitude corresponding to the amplitude information by forming an integral or a sum of amplitude values of a compressed spectral model in the range of the target channel; and applying the amplitude corresponding to the amplitude information to a signal in a target channel of the plurality of frequency channels, on which the source channel is mapped during frequency compression, and thereby maintaining a phase of the audio signal in the target channel.

* * * * *